US007100548B2

(12) United States Patent
Takahashi et al.

(10) Patent No.: US 7,100,548 B2
(45) Date of Patent: Sep. 5, 2006

(54) V-TYPE 8-CYLINDER FOUR CYCLE INTERNAL COMBUSTION ENGINE

(75) Inventors: Naoki Takahashi, Yokohama (JP); Katsuya Moteki, Tokyo (JP); Masayuki Hara, Kanagawa (JP); Hajime Miura, Tokyo (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 11/104,614

(22) Filed: Apr. 13, 2005

(65) Prior Publication Data

US 2005/0263115 A1 Dec. 1, 2005

(30) Foreign Application Priority Data

Jun. 1, 2004 (JP) ..... 2004-162679

(51) Int. Cl.
*F02B 75/22* (2006.01)
*F02B 75/32* (2006.01)

(52) U.S. Cl. ..... 123/54.7; 123/197.4

(58) Field of Classification Search ..... 123/54.7, 123/197.4, 192.2, 48 B
See application file for complete search history.

(56) References Cited

U.S. PATENT DOCUMENTS

| | | | |
|---|---|---|---|
| 3,633,429 | A | 1/1972 | Olson |
| 6,390,035 | B1 | 5/2002 | Moteki et al. |
| 6,505,582 | B1 | 1/2003 | Moteki et al. |
| 6,622,670 | B1 | 9/2003 | Hiyoshi et al. |
| 6,729,273 | B1 * | 5/2004 | Aoyama et al. ..... 123/48 B |

FOREIGN PATENT DOCUMENTS

| | | | |
|---|---|---|---|
| EP | 1 236 877 | A2 | 9/2002 |
| JP | 8-193643 | A | 7/1996 |
| JP | 2001-227367 | A | 8/2001 |
| JP | 2002-21592 | A | 1/2002 |
| JP | 2002-54468 | A | 2/2002 |
| JP | 2002-129995 | A | 5/2002 |
| JP | 2002-227674 | A | 8/2002 |

OTHER PUBLICATIONS

Von Christop Bollig et al., *Kurbel Trieb Für Variable Verdichtung;* MTZ Motortechnische Zeitschrift; (1997) vol. 58, Issue No. 11, pp. 706-711.

* cited by examiner

*Primary Examiner*—Stephen K. Cronin
*Assistant Examiner*—Hyder Ali
(74) *Attorney, Agent, or Firm*—Foley & Lardner LLP

(57) ABSTRACT

A V-type 8-cylinder four cycle internal combustion engine has a bank angle of 90 deg. and employs a double link type piston-crank mechanism for transmitting the force of each piston to a crankshaft. The double link type piston-crank mechanism comprises an upper link that has one end pivotally connected to the piston, a lower link that is rotatably supported by a crank pin of the crankshaft and has one end pivotally connected to the other end of the upper link, and a control link that has one end pivotally connected to the other end of the lower link and the other end pivotally connected to a cylinder block. Preferably, the crankshaft is of a single plane type in which all of the four throws are in a common plane.

11 Claims, 12 Drawing Sheets

REFERENCE-2

REFERENCE-2

V-TYPE 8-CYLINDER FOUR CYCLE INTERNAL COMBUSTION ENGINE

BACKGROUND OF THE INVENTION

1. Field of the Invention

The present invention relates in general to V-type 8-cylinder four cycle internal combustion engines with a bank angle of 90 deg., and more particularly to the engines of a type that has a double link type piston-crank mechanism that employs a plurality of links for operatively connecting a crankshaft and each piston.

2. Description of the Related Art

Hitherto, as a means for providing the engine with a variable compression ratio, there has been proposed a type that practically uses a double link type piston-crank mechanism. The mechanism comprises an upper link that has one end pivotally connected to a piston through a piston pin, a lower link that is pivotally connected to the other end of the upper link and pivotally supported by a crankpin of a crankshaft, and a control link that has one end pivotally connected to the lower link for controlling the posture of the lower link. In accordance with an operation condition of the engine, the other end of the control link, that forms a swing fulcrum, is forced to change its position. With this, the posture of the lower link is varied and thus, a stroke characteristic of the piston is changed permitting the engine to have a variable compression ratio.

For controlling such engines, one operation method has been hitherto proposed wherein when the engine is under a low operation load, a higher compression ratio is set for improving the fuel consumption and when the engine is under a high operation load, a lower compression ratio is set for suppressing an excessive pressure generated in each cylinder. By practically using this method, a unique system has been thought out wherein the compression ratio is controlled to vary in accordance with the engine operation condition. In internal combustion engines employing such system, both reduction in fuel consumption and increase in engine power are achieved at the same time.

In the engines having the above-mentioned double link type piston-crank mechanism installed therein, it is known that a secondary vibration component of an inertia force produced by reciprocating movement of each piston is reduced, as is described in Japanese Laid Open Patent Application (Tokkai) 2001-227367. This advantageous effect is brought by a multi-articulation possessed by the double link type mechanism through which the piston and the crank pin are operatively connected. It has been revealed that a mechanism for moving the position of the swing fulcrum of the control link has substantially no influence on such advantageous vibration reduction effect.

For effective reduction of the secondary vibration component of the inertia force of the piston, various methods have been proposed and put into practical use, which are disclosed in, for example, the above-mentioned published Application 2001-227367, Japanese Laid-open Patent Application (Tokkai) 2002-227674 and Japanese Laid-open Patent Application (Tokkai) 2002-129995.

SUMMARY OF THE INVENTION

When, in case of V-type 8-cylinder four cycle internal combustion engines, a single plane type crankshaft that has all of four throws thereof placed in the same plane is used, the firing interval is 180 deg. for each bank and thus intake and exhaust timings have the same interval. In this case, undesired intake interference and/or exhaust interference of the cylinders of each bank can be avoided or at least minimized, and thus pulsation effect of each cylinder can be practically used, which increases an output performance of the engine.

However, in V-type 8-cylinder four cycle internal combustion engines having the above-mentioned single plane type crankshaft installed therein, each piston tends to fail to have a balanced inertial force when reciprocating in the corresponding cylinder, and under operation of the engine, an force caused by a secondary vibration component in a horizontal direction of the inertia force shows a remarkable value. This phenomenon is quite undesirable to the engines for motor vehicles, particularly for luxury motor vehicles that require a very smoothed and vibration free running.

One method of solving this phenomenon is disclosed in Japanese Laid-open Patent Application (Tokkaihei) 8-193643, wherein balancer shafts are employed for canceling the secondary inertia force. That is, in this measure, two balancer shafts are arranged along the crankshaft and forced to rotate at a speed twice as fast as that of the crankshaft. However, due to the inherent construction, the engines of this type are complicated in construction and thus heavy in weight and bulky in size.

While, when, in case of V-type 8-cylinder four cycle internal combustion engines, a double plane type crankshaft having two pairs of throws thereof intersecting each other at an angle of 90 deg. is employed, the pistons in respective cylinders show a sufficiently balanced movement. That is, under operation of the engine, the secondary vibration component of the inertia force of each piston is substantially zero. Thus, the engines with the double plane type crankshaft is desirable for luxury motor vehicles. However, in such engines, the firing interval of each bank is not even, and thus, such engines are not suitable for outputting a large engine power.

Furthermore, in general, the V-type 8-cylinder four cycle internal combustion engines tend to show a poor fuel consumption as compared with engines of 4-cylinder or 6-cylinder type.

Accordingly, it is an object of the present invention to provide a V-type 8-cylinder four cycle internal combustion engine which is free of the above-mentioned drawbacks.

It is another object of the present invention to provide a V-type 8-cylinder four cycle internal combustion engine with a bank angle of 90 deg., which is free of the above-mentioned drawbacks.

In accordance with a first aspect of the present invention, there is provided a V-type 8-cylinder four cycle internal combustion engine, which comprises a first group of four pistons respectively received in cylinders of a first bank; a second group of four pistons respectively received in cylinders of a second bank, the second bank intersecting the first bank at an angle of 90 deg.; a crankshaft including four throws each having a crank pin; a first upper link having one end pivotally connected to one of the four pistons of the first group; a second upper link having one end pivotally connected to one of the four pistons of the second group; a first lower link rotatably supported by the crank pin of the crankshaft and having one end pivotally connected to the other end of the first upper link; a second lower link rotatably supported by the crank pin of the crankshaft and having one end pivotally connected to the other end of the second upper link; a first control link having one end pivotally connected to the other end of the first lower link and the other end pivotally connected to a cylinder block; and a second control link having one end pivotally connected to the other end of the second lower link and the other end pivotally connected to the cylinder block.

In accordance with a second aspect of the present invention, there is provided a V-type 8-cylinder four cycle internal combustion engine with a bank angle of 90 deg., which comprises a first group of four pistons respectively received in cylinders formed in a first bank; a second group of four pistons respectively received in cylinders defined in a second bank; a crankshaft including four throws each having a crank pin; a first group of four upper links each having one end pivotally connected to one of the pistons of the first group; a second group of four upper links each having one end pivotally connected to one of the pistons of the second group; a first group of four lower links rotatably and respectively supported by the four crank pins of the throws of the crankshaft, each lower link of the first group having one end pivotally connected to the other end of the corresponding upper link of the first group; a second group of four lower links rotatably and respectively supported by the four crank pins of the throws of the crankshaft, each lower link of the second group having one end pivotally connected to the other end of the corresponding upper link of the second group; a first group of four control links each having one end pivotally connected to the other end of the corresponding lower link of the first group and the other end pivotally connected to a cylinder block; and a second group of four control links each having one end pivotally connected to the other end of the corresponding lower link of the second group and the other end pivotally connected to the cylinder block.

In accordance with a third aspect of the present invention, there is provided a V-type 8-cylinder four cycle internal combustion engine with a bank angle of 90 deg., which comprises a first group of four pistons respectively received in cylinders formed in a first bank; a second group of four pistons respectively received in cylinders defined in a second bank, the second bank intersecting the first bank at an angle of 90 deg.; a single plane type crankshaft that has four throws placed on a common plane, each throw having a crank pin; a first group of four upper links each having one end pivotally connected to one of the pistons of the first group through a piston pin; a second group of four upper links each having one end pivotally connected to one of the pistons of the second group through a piston pin; a first group of four lower links rotatably and respectively supported by the four crank pins of the throws of the crankshaft, each lower link of the first group having one end pivotally connected to the other end of the corresponding upper link of the first group; a second group of four lower links rotatably and respectively supported by the four crank pins of the throws of the crankshaft, each lower link of the second group having one end pivotally connected to the other end of the corresponding upper link of the second group; a first group of four control links each having one end pivotally connected to the other end of the corresponding lower link of the first group; a second group of four control links each having one end pivotally connected to the other end of the corresponding lower link of the second group; a first control shaft rotatably supported by a cylinder block, the first control shaft having four eccentric portions to which the other ends of the control links of the first group are pivotally connected; and a second control shaft rotatably supported by the cylinder block, the second control shaft having four eccentric portions to which the other ends of the control links of the second group are pivotally connected.

DETAILED DESCRIPTION OF THE INVENTION

In the following, the present invention will be described in detail with reference to the accompanying drawings.

Figure 1:
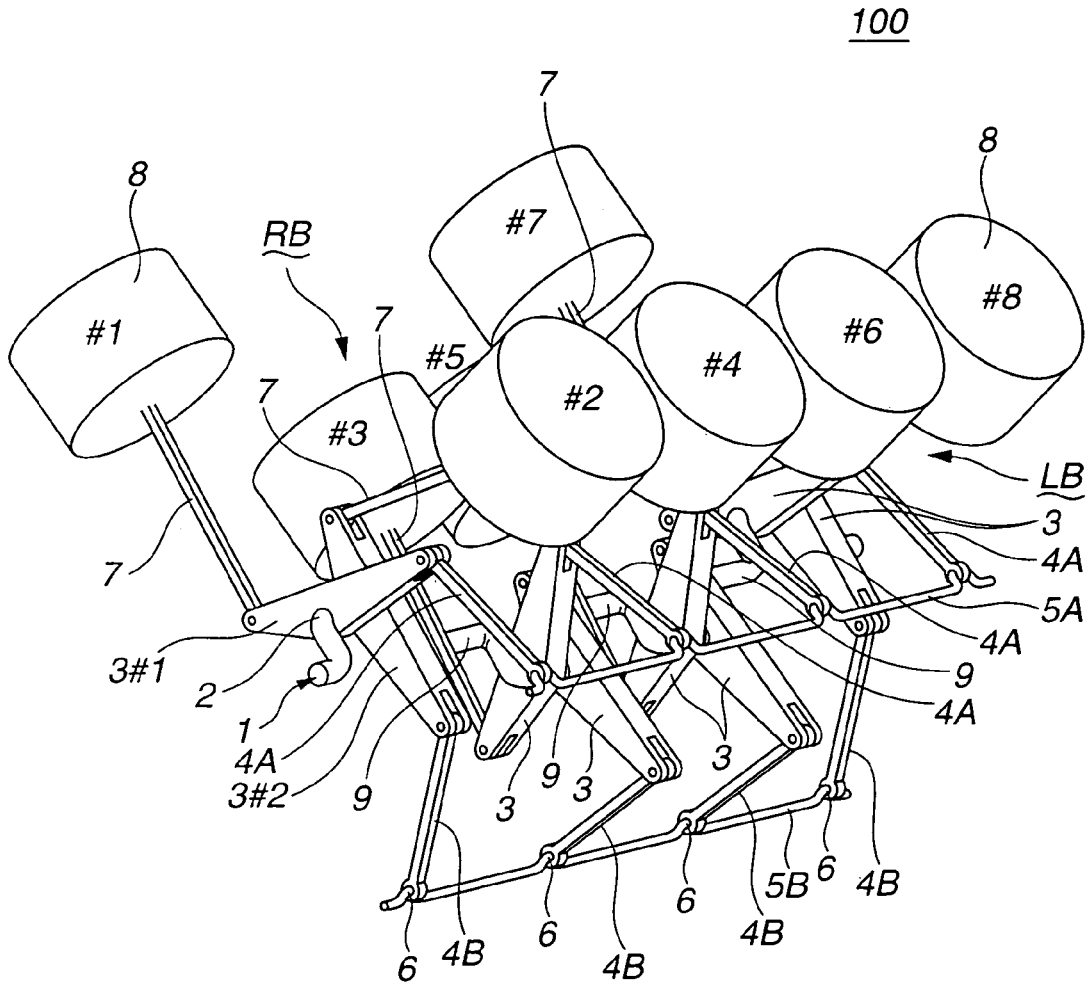
FIG. 1 is a perspective view of a double link type piston-crank mechanism that is practically installed in a V-type 8-clinder four cycle internal combustion engine of the present invention.
Figure 2:
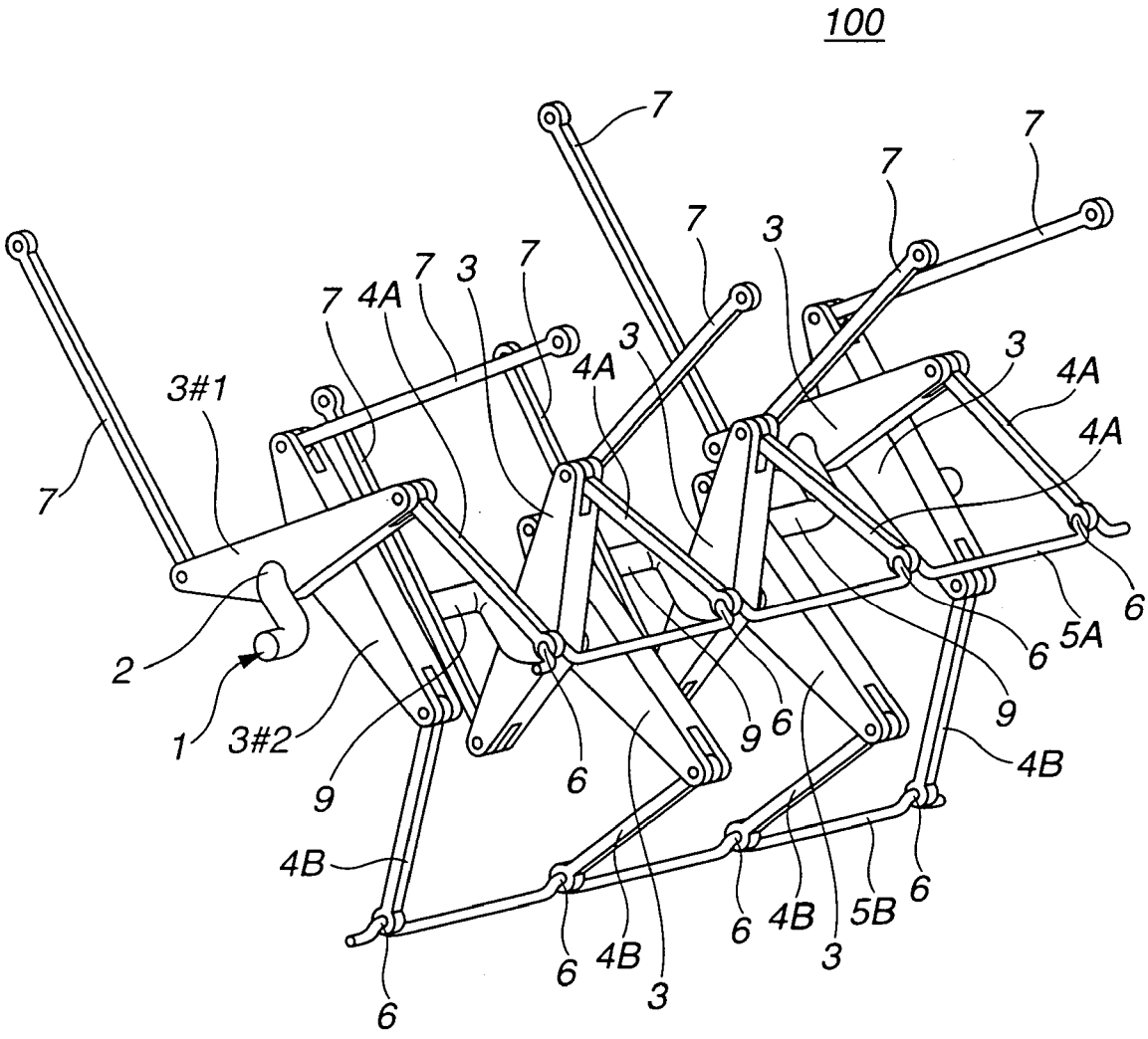
FIG. 2 is a view similar to FIG. 1, but with pistons removed.

Referring to FIGS. 1 and 2, particularly FIG. 1, there is schematically shown a V-type 8-cylinder four cycle internal combustion engine 100 to which the present invention is practically applied. It is to be noted that FIG. 2 is a view of the engine 100 with eight pistons removed for clarification of arrangement of parts of a double link type piston-crank mechanism employed.

As is seen from FIGS. 1 and 2, engine 100 of the present invention comprises a crankshaft 1 that has a center shaft (or journal) portion that extends horizontally. In these drawings, left and right ends of crankshaft 1 are positioned at front and rear portions of the engine 100, respectively.

As is understood from FIG. 1, a right bank "RB" (not shown) of the engine 100 has four cylinders #1, #3, #5 and #7 that are arranged in order from the front portion, and a left bank "LB" (not shown) of the engine 100 has four cylinders #2, #4, #6 and #8 that are arranged in order from the front portion.

It is to be noted that a bank angle defined by right and left banks "RB" and "LB" is 90 deg. That is, in the engine 100, an imaginary plane that includes center axes of four cylinders #1, #3, #5 and #7 and another imaginary plane that includes center axes of the outer four cylinders #2, #4, #6 and #8 intersect at an angle of 90 deg.

Crankshaft 1 is of a four throw type wherein two adjacent cylinders in right and left banks "RB" and "LB" are attached to each crank pin 2 (or each throw). Furthermore, crankshaft 1 is of a single plane type wherein journal portions 9 and four crank pins 2 are placed on a common imaginary plane.

The firing order of the engine 100 is #1-#8-#5-#4-#7-#2-#3-#6 or #1-#4-#5-#2-#7-#6-#3-#8. That is, the firing interval is 180 deg. in crank angle for each bank "RB" or "LB" and thus intake and exhaust timings have the same internal.

As is understood from FIGS. 1 and 2, engine 100 of the present invention is equipped with a double link type piston-crank mechanism that comprises eight upper links 7 and eight lower links 3 (two of which are denoted by 3#$_1$ and 3#$_2$).

As shown, each of pistons 8 and crankshaft 1 are operatively connected through one upper link 7 and one lower link 3. By changing attitude of lower links 3 by an aftermentioned mechanism, stroke of pistons 8 is varied and thus compression ratio of the engine 100 is varied.

As is seen from FIG. 2, each lower link 3 is rotatably disposed about the corresponding crank pin 2 of crankshaft 1. It is to be noted that two lower links 3 for adjacent cylinders in right and left banks "RB" and "LB", for example, lower link 3#$_1$ for cylinder #1 of right bank "RB" and lower link 3#$_2$ for cylinder #2 of left bank "LB" are attached to a common crank pin 2.

Each lower link 3 has one arm portion that extends radially outward from the corresponding crank pin 2 to pivotally connect to a lower end of the corresponding upper link 7.

Figure 7:
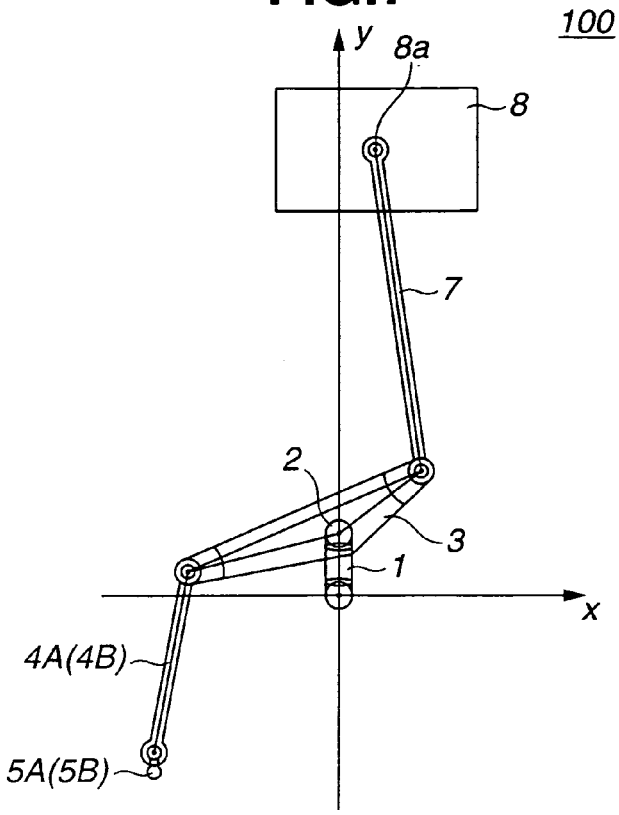
FIG. 7 is a view of one unit of the double link type piston-crank mechanism of the present invention, showing essential parts incorporated with one pispon.

As is seen from FIG. 7, an upper end of upper link 7 is pivotally connected to the corresponding piston 8 through a piston pin 8*a*.

Referring back to FIGS. 1 and 2, each lower link 3 has another arm portion that extends radially outward from the corresponding crank pin 2 to pivotally connect to one end of a control link 4A or 4B.

It is to be noted that the four control links 4A are those which are respectively connected to lower link 3#$_1$ for piston #1, lower link 3 for piston #3, lower link 3 for piston #5 and lower link 3 for piston #7, and the other four control links 4B are those which are respectively connected to lower link 3#$_2$, lower link 3 for piston #4, lower link 3 for piston #6 and lower link for piston #8.

In other words, the four control links 4A are provided by the four cylinders defined in right bank "RB", and the other four control links 4B are provided by the other four cylinders defined in left bank "LB".

The other end of each control link 4A or 4B is swingably supported by a cylinder block of the engine 100, so that movement of lower links 3 can be controlled in such a manner that an angular position of lower links 3 relative to corresponding crank pins 2 is adjustable.

More specifically, as is seen from FIG. 2, the other ends of four control links 4A are pivotally connected to respective eccentric portions 6 of a common control shaft 5A, and the other ends of the other four control links 4B are pivotally connected to respective eccentric portions 6 of another common control shaft 5B. Thus, each control link 4A or 4B is permitted to swing using the eccentric portion 6 as a fulcrum.

As is understood from FIGS. 1 and 2, the two control shafts 5A and 5B are arranged at the same side of the engine 100. In other words, each of the eight lower links 3 has a left end from which the upper link 7 extends and a right end from which the control link 4A or 4B extends, as viewed in FIGS. 1 and 2.

Each common control shaft 5A or 5B is rotatably supported on a given section of the cylinder block (not shown) of the engine 100. Although not shown in the drawings, each control shaft 5A or 5B is arranged to rotate about its axis by an actuator such as an electric motor or the like. Thus, upon energization of the actuator, the respective eccentric portions 6 of each control shaft 5A or 5B are forced to move around the axis of the control shaft 5A or 5B, and thus the swing manner of each control link 4A or 4B is changed thereby varying the moving manner of each lower link 3 and each upper link 7. With this, the moving manner (or trace way) of each piston 8 is continuously changed thereby to continuously vary the compression ratio of the engine 100.

In order to make clear the constructional feature of the engine 100 of the present invention, known V-type 8-cylinder four cycle engines "Reference-1" and "Reference-2" will be briefly described in the following.

Figure 3:
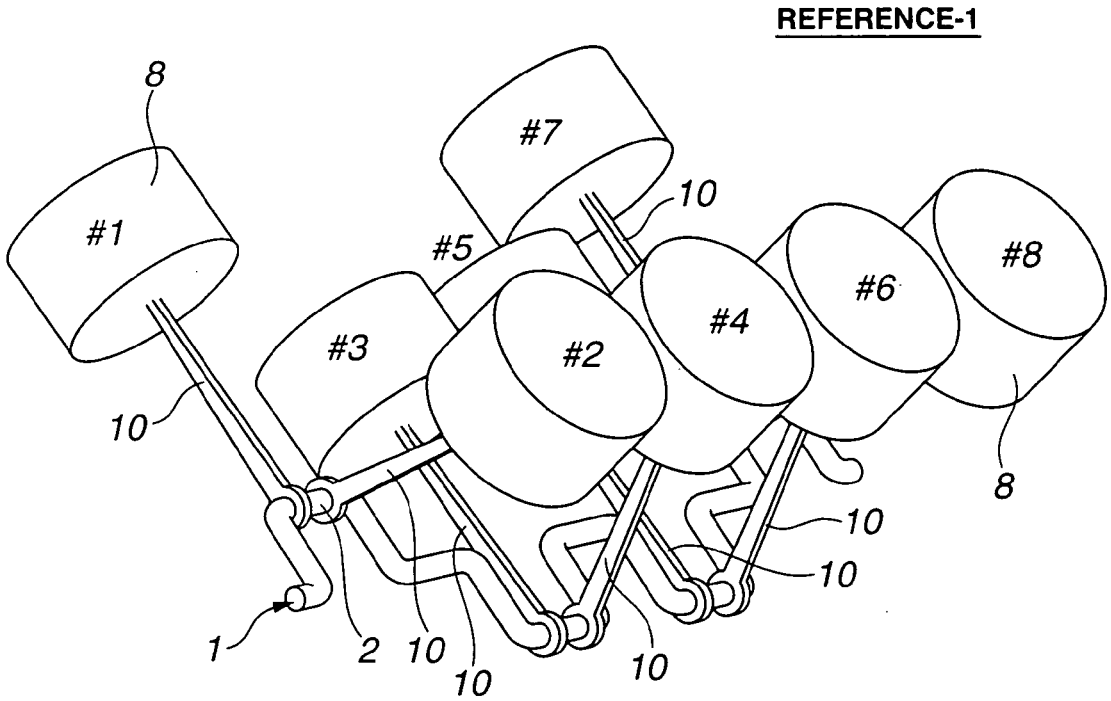
FIG. 3 is a perspective view of a single link type piston-crank mechanism that is practically installed in an engine of Reference-1.
Figure 4:
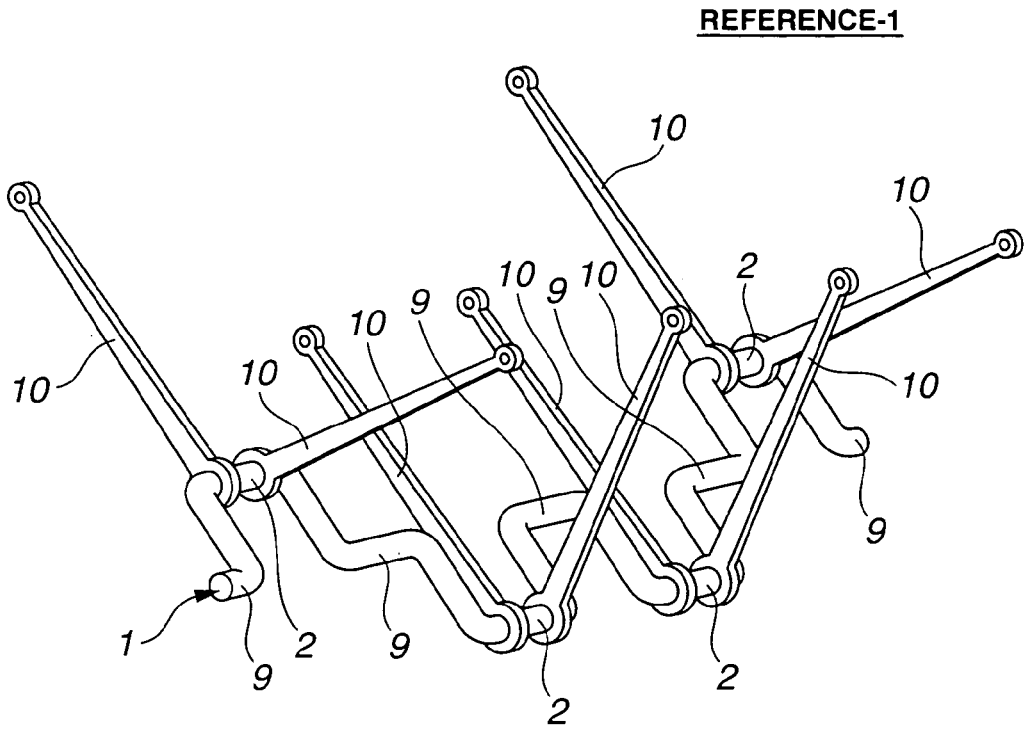
FIG. 4 is a view similar to FIG. 3, but with pistons removed.

In FIGS. 3 and 4, there is schematically shown V-type 8-cylinder four cycle internal combustion engine "Reference-1" to which a single link type piston-crank mechanism is practically applied. It is to be noted that FIG. 4 is a view of the engine "Reference-1" with eight pistons removed for clarification of an arrangement of parts of the single link type piston-crank mechanism.

Figure 8:
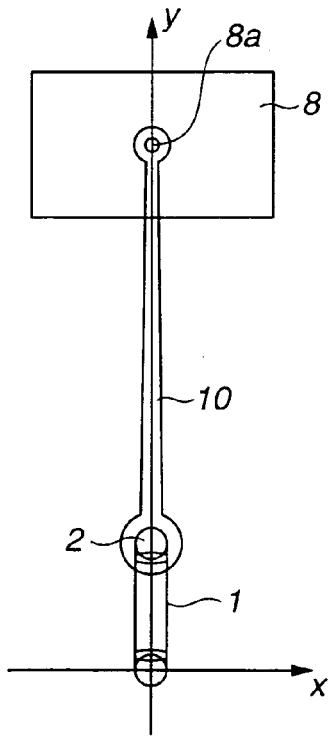
FIG. 8 is a view of one unit of the single link type piston-crank mechanism employed in the engine "Reference-1", showing essential parts incorporated with one piston.

As is seen from the drawings, the engine "Reference-1" is equipped with the single link type piston-crank mechanism that employs only eight connecting rods 10 for transmitting the reciprocating movement of eight pistons 8 to crankshaft 1. That is, each connecting rod 10 has an upper end pivotally connected to piston 8 through a piston pin 8*a* (see FIG. 8) and a lower end pivotally connected to a crank pin 2 of crankshaft 1.

Like in the above-mentioned engine 100 of the present invention, crankshaft 1 employed in the engine "Reference-1" is of a single plane type wherein the journal portions 9 and four crank pins 2 are arranged on a common imaginary plane as is understood from FIG. 4.

Figure 5:
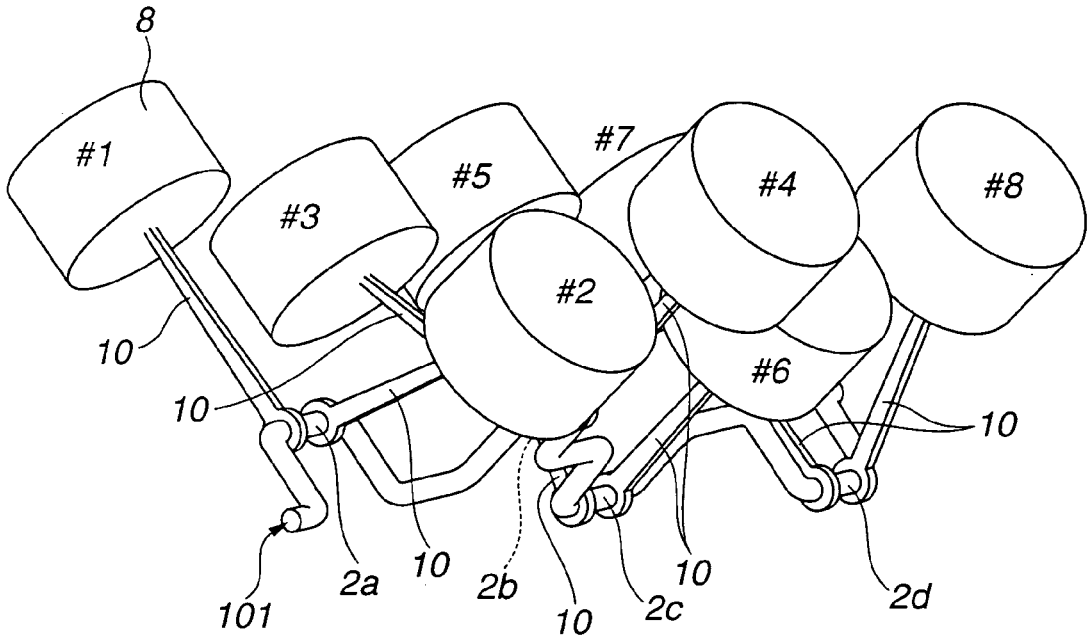
FIG. 5 is a perspective view of another single link type piston-crank mechanism that is practically installed in an engine of Reference-2.
Figure 6:
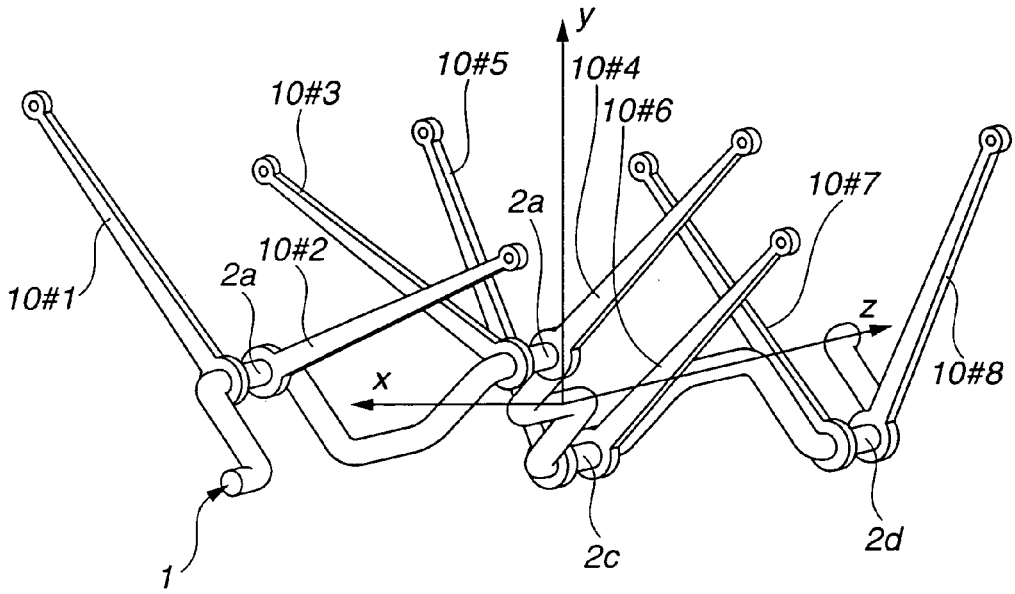
FIG. 6 is a view similar to FIG. 5, but with pistons removed.

In FIGS. 5 and 6, there is shown V-type 8-cylinder four cycle internal combustion engine "Reference-2" to which another single link type piston-crank mechanism is practically applied. It is to be noted that FIG. 6 is a view of the engine "Reference-2" with eight pitons removed for clarification of arrangement of the single link type-piston-crank mechanism.

In the engine "Reference-2", a double plane type crankshaft 101 is employed.

As is understood from FIG. 6, the double plane type crankshaft 101 is constructed to have a first imaginary plane that places thereon both a first crank pin 2*a* from which connecting rods 10#$_1$ and 10#$_2$ for pistons #1 and #2 extend and a fourth crank pin 2*d* from which connecting rods 10#$_7$ and 10#$_8$ for pistons #7 and #8 extend, and a second imaginary plane that places thereon both a second crank pin 2*b* from which connecting rods 10#$_3$ and 10#$_4$ for pistons #3 and #4 extend and a third crank pin 2*c* from which connecting rods 10#$_5$ and 10#$_6$ for pistons #5 and #6 extend, the first and second imaginary planes intersecting at right angles (90 deg.).

In FIG. 6, there are shown three coordinate axes "x", "y" and "z" that are provided for clarifying the directional relation between crankshaft 101 and each of connecting rods 10#$_1$ to 10#$_8$ under operation of the engine "Reference-2". The axis "x" is perpendicular to the axis of crankshaft 101 and extends horizontally to define an angle of 90 deg. relative to a center line of the two banks "RB" and "LB", the axis "y" extends vertically in the direction of the center line of the two banks "RB" and "LB", and the axis "z" extends in and along the axis of crankshaft 101.

In engine 100 of the present invention (see FIG. 1) and engine "Reference-1" (see FIG. 3) that employ a single plane type crankshaft 1, the firing order is usually #1-#8-#5-#4-#7-#2-#3-#6 or #1-#4-#5-#2-#7-#6-#3-#8. Thus, the firing interval is 180 deg. in crank angle for each bank "RB" or "LB".

While in engine "Reference-2" (see FIG. 5) that employs a double plane type crankshaft 101, the firing order is usually #1-#8-#7-#3-#6-#5-#4-#2. Thus, during operation of engine "Reference-2", there is inevitably produced such a chance that the firing interval is 90 deg. in crank angle for each bank "RB" or "LB", and thus, so-called even firing interval is not obtained in each bank "RB" or "LB" in the engine "Reference-2". Because of this non-even firing internal, two cylinders in one bank "RB" or "LB" (such as two cylinders #7 and #3 in right bank "RB" and two cylinders #4 and #2 in left bank "LB") that have the firing interval of 90 deg. therebetween are subjected to undesired intake interference and/or exhaust interference, and thus, the intake and exhaust efficiency is sacrificed in the engine "Reference-2". That is, in general, engines of the type "Reference-2" are not suitable for producing a large output power.

In the following, a vibration damping effect exhibited by the double link type piston-crank mechanism employed by the engine 100 of the present invention will be described with reference to FIG. 7.

FIG. 7 shows one unit of the double link type piston-crank mechanism employed in the engine 100 of the present invention, which includes a piston 8, an upper link 7, a lower link 3, a crank pin 2, a control link 4A or 4B and a common control shaft 5A or 5B. For ease of understanding, the direction, viz., the direction of axis "y" in which piston 8 moves is illustrated to extend vertically in the drawing, and the drawing is taken from a rear end of engine 100. It is to be noted that crankshaft 1 shown in the drawing is rotated in a counterclockwise direction.

When reciprocating in the cylinder, piston 8 produces an inertia force. The inertia force is transmitted to upper link 7, and to lower link 3 together with an inertia force produced by upper link 7 itself. The inertia force transmitted to lower link 3 is then transmitted to crankshaft 1 and control link 4A or 4B together with an inertial force produced by lower link 3 itself. The inertia force transmitted to crankshaft 1 and that transmitted to control link 4A or 4B are then transmitted to the cylinder block through a bearing for the journal portion of crankshaft 1 and control shaft 5A or 5B, respectively.

Figure 9:
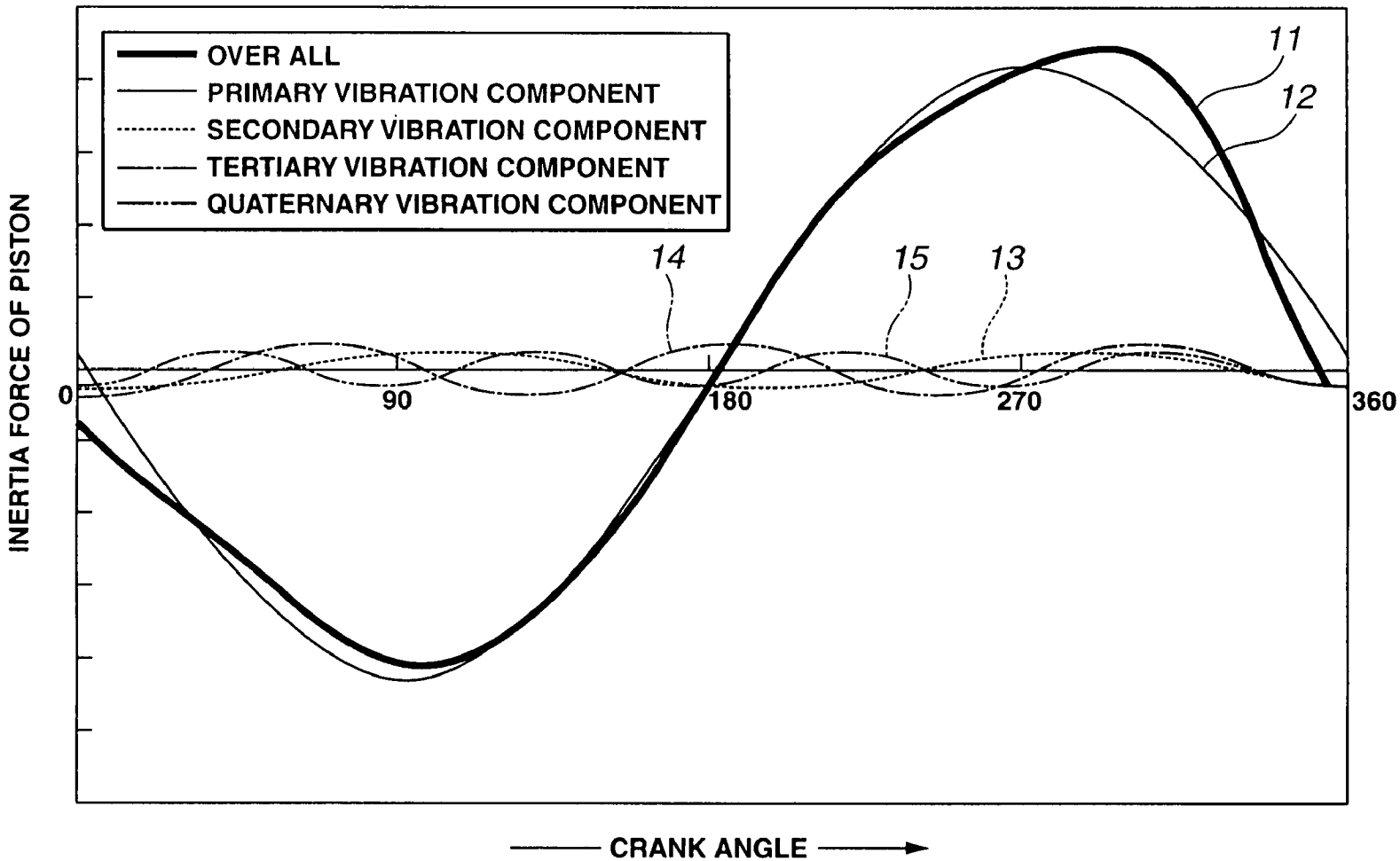
FIG. 9 is a graph showing a characteristic of the engine of the present invention, in terms of relationship between a crank angle and an inertial force of each piston.

FIG. 9 is a graph showing various components of the inertial force transmitted to the cylinder block, that have a direction of the axis "y" in which piston moves or reciprocates. In the graph, the curve denoted by numeral 11 shows an overall value of the inertial force, and the curves denoted by numerals 12, 13, 14 and 15 show values of primary, secondary, tertiary and quaternary vibration components of the inertia force, respectively.

Referring back to FIG. 8, there is shown one unit of the single link type piston-crank mechanism employed in engine "Reference-1", which includes a piston 8, a connecting rod 10 and a crank pin 2. It is to be noted that crankshaft 1 shown in the drawing is rotated in a counterclockwise direction.

When reciprocating in the cylinder, piston 8 produces an inertia force. The inertia force is transmitted to connecting rod 10, and to crankshaft 1 together with an inertia force produced by connecting rod 10 itself. The inertia force transmitted to crankshaft 1 is then transmitted to the cylinder block together with an inertia force produced by crankshaft 1 itself through a bearing for the journal portion of crankshaft 1.

Figure 10:
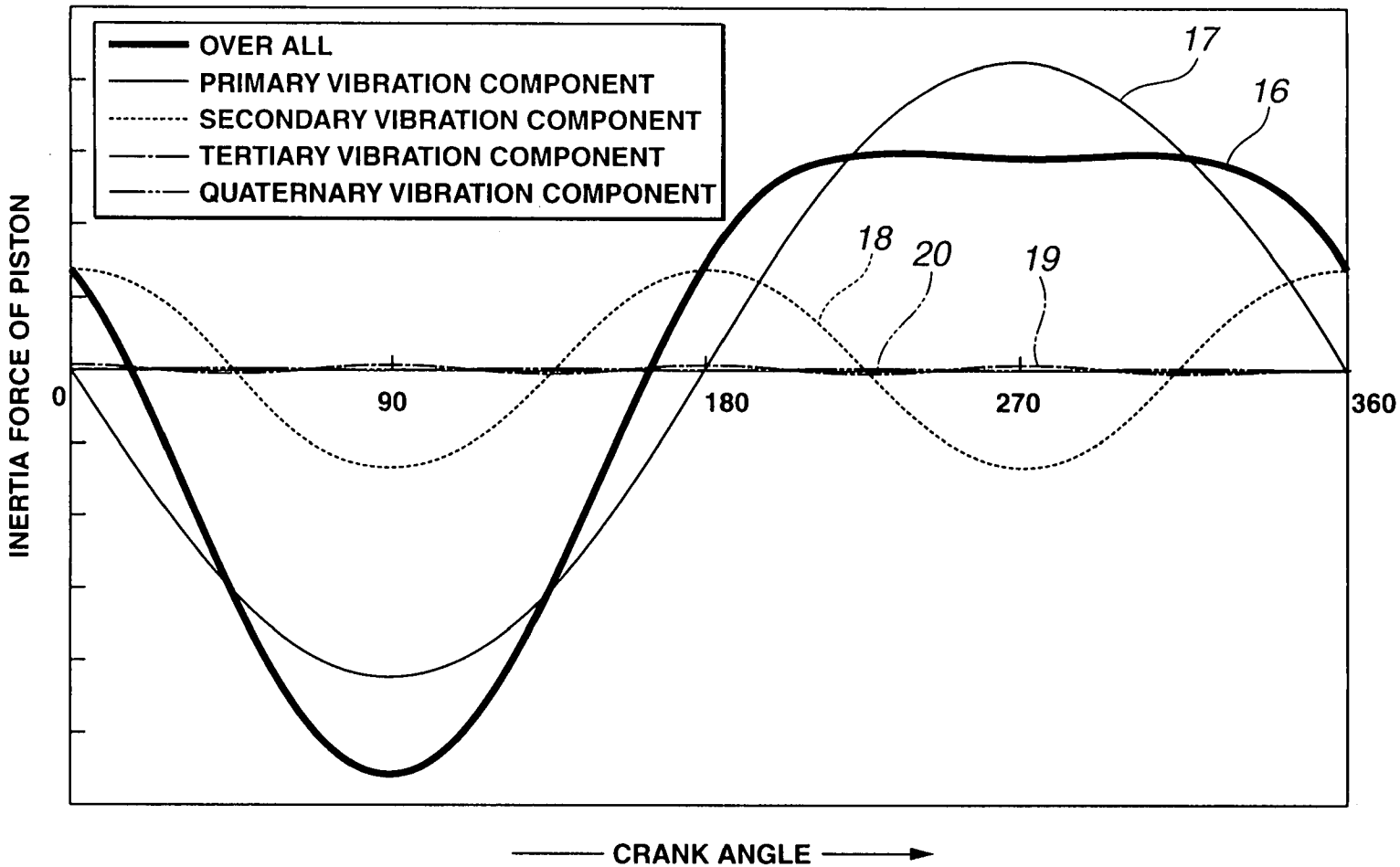
FIG. 10 is a graph similar to FIG. 9, but showing a characteristic of the engine of Reference-1.

FIG. 10 is a graph showing various components of the inertia force transmitted to the cylinder block, that have a direction of the axis "y" in which piston moves or reciprocates. In the graph, the curve denoted by numeral 16 shows an overall value of the inertia force, and the curves denoted by numerals 17, 18, 19 and 20 show values of primary, secondary, tertiary and quaternary vibration components of the inertia force, respectively.

As will be understood when comparing FIGS. 9 and 10, in the engine 100 of the present invention that employs the double link type piston-crank mechanism, vibration components, particularly, the secondary vibration component, of the inertia force show a reduced degree as compared with those of the engine "Reference-1" that employs the single link type piston-crank mechanism. Thus, the curve 11 (see FIG. 9) of the overall value of the inertial force of the engine 100 of the present invention shows a waveform that is much close to a normal sine wave as compared with the curve 16 (see FIG. 10) of that of the engine "Reference-1". This means that in the engine 100 of the invention, each piston 8 exhibits a simpler harmonic motion during its reciprocating operation.

As is described hereinabove, in the engine 100 of the present invention, there are employed both the double link type piston-crank mechanism and the single plane type crankshaft 1.

That is, in the engine 100 of the invention, due to employment of the double link type piston-crank mechanism and the single plane type crankshaft 1, higher engine power is achieved and at the same time, undesired engine vibration is reduced or at least minimized.

In addition to the above-mentioned inertia force that has the direction of the axis "y", an inertia force in a direction of the axis "x" (see FIG. 6) and a moment (viz., counterforce of engine torque) around the axis "z" are applied to the cylinder block of the engine.

Figure 11A:
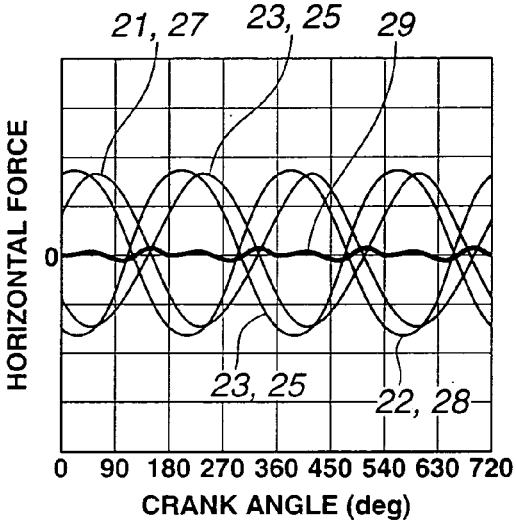
FIGS. 11A, 11B, 11C and 11D are graphs similar to FIG. 9, but respectively showing inertia forces and moments of eight pistons in case of the engine of the present invention.
Figure 11B:
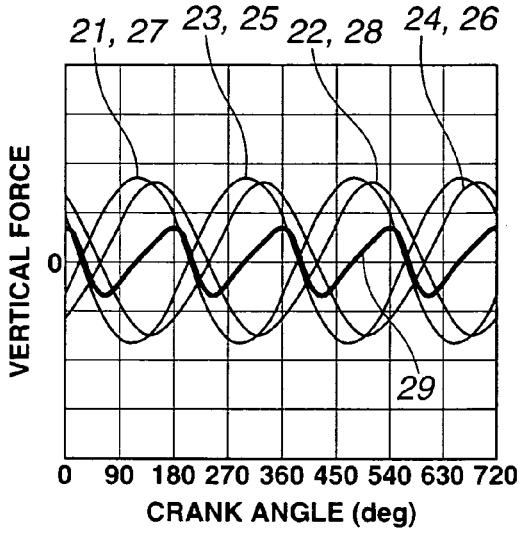
Figure 11C:
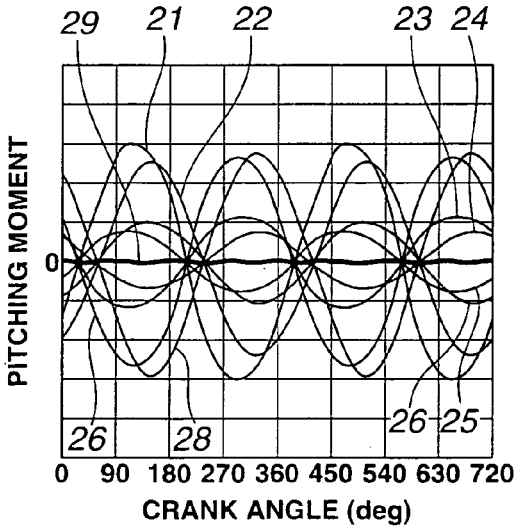
Figure 11D:
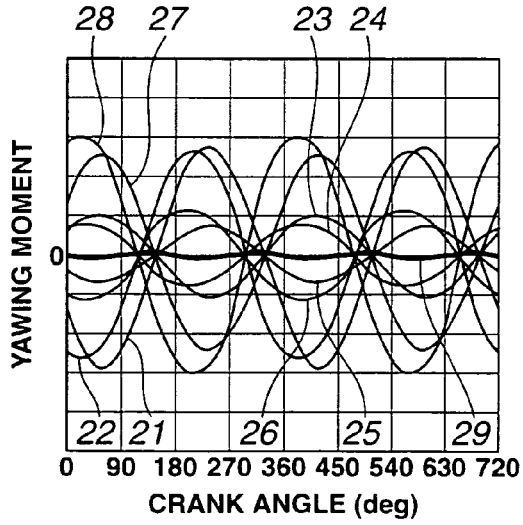

That is, FIGS. 11A to 11D are graphs showing various inertia forces and moments caused by eight pistons of the engine 100 of the present invention. More specifically, FIG. 11A shows a horizontal component of the inertial force (viz., moment in the direction of the axis "x"), FIG. 11B shows a vertical component of the inertial force (viz., moment in the direction of the axis "y"), FIG. 11C shows a pitching moment (viz., moment around the axis "x") and FIG. 11D shows a yawing moment (viz., moment around the axis "y").

FIGS. 12A to 12D are graphs showing various inertia forces and moments caused by eight pistons of the engine "Reference-1". More specifically, FIGS. 12A to 12D show horizontal, vertical, pitching and yawing moments of the inertia force respectively.

FIGS. 13A to 13D are graphs showing various inertia forces and moments caused by eight pistons of engine "Reference-2" with respect to the crank angle. More specifically, FIGS. 13A to 13D show horizontal, vertical, pitching and yawing moments of the inertial force respectively.

In each of the graphs 11A to 11D, 12A to 12D and 13A to 13D, the curves denoted by numerals 21 to 28 show the components of the inertial force of pistons #1, #2, #3, #4, #5, #6, #7 and #8, respectively, and the curve denoted by numeral 29 shows the overall value of the components.

Figure 12A:
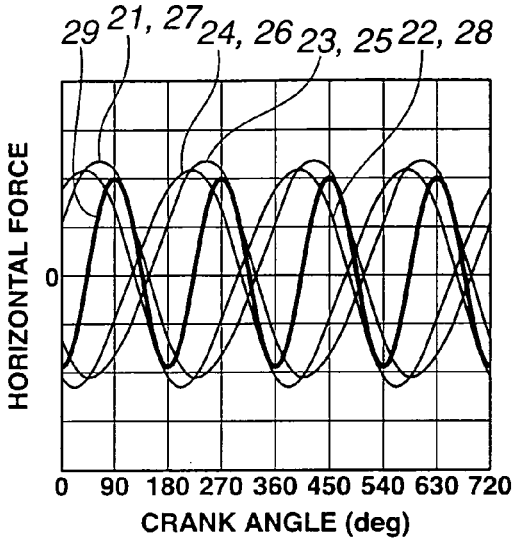
FIGS. 12A, 12B, 12C and 12D are graphs similar to FIGS. 11A, 11B, 11C and 11D, but showing inertia forces and moments of eight pistons in case of the engine of Reference-1.
Figure 12B:
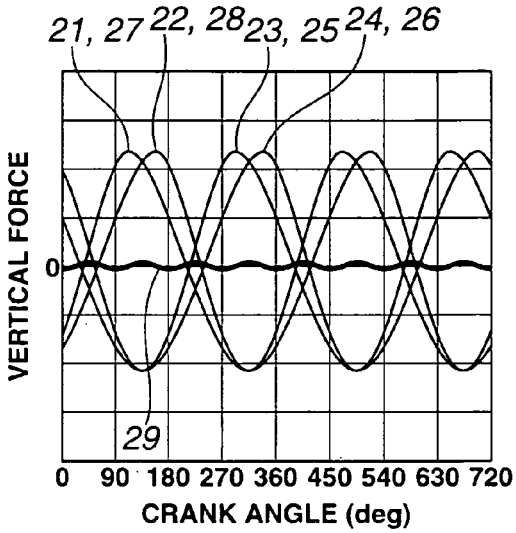

As is understood from FIG. 12A, in the engine "Reference-1" (viz., the engine to which the single link type piston-crank mechanism and the single plane type crankshaft 1 are practically applied), the secondary vibration component of the inertia force is remarked. While, as is seen from FIG. 11A, in the engine 100 of the present invention, such vibration component is very small.

Figure 12C:
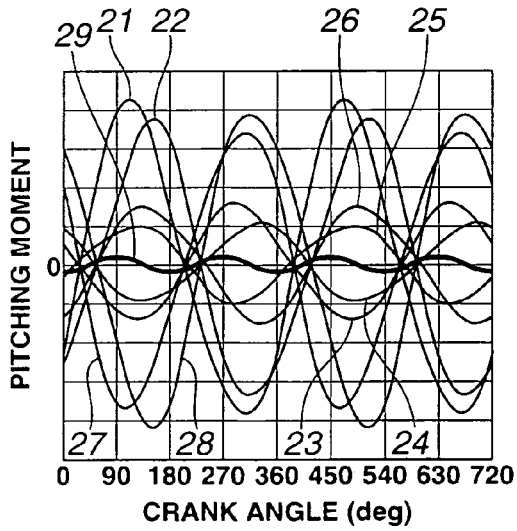
Figure 12D:
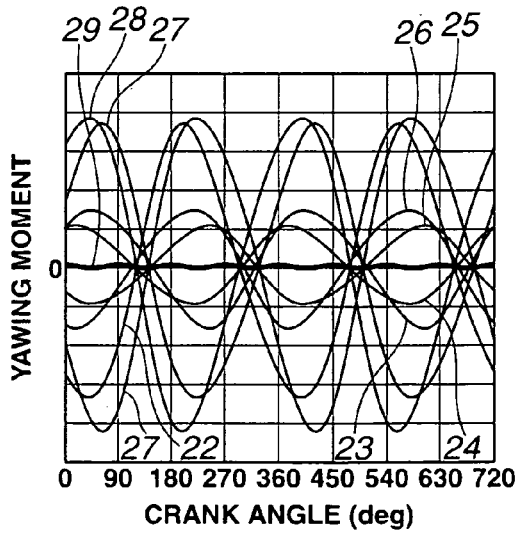

As is understood from FIG. 12C, the engine "Reference-1" is subjected to a certain degree pitching moment. While, as is seen from FIG. 11C, in the engine 100 of the present invention, such pitching moment is quite small.

Although, as is understood from FIG. 11B, the engine 100 of the present invention is subjected to a certain secondary vibration of the inertial force in the vertical direction, the degree of the vibration is quite small as compared with that (see FIG. 12B) of the engine "Reference-1".

As is seen from the above, the engine 100 of the present invention is quite improved with respect to reduction in the secondary vibration component of the inertia force as compared with engine "Reference-1". In other words, the engine 100 of the present invention can exhibit a vibration characteristic similar to that of engine "Reference-2".

Accordingly, in the engine 100 of the present invention, both the vibration reduction effect and higher power output effect are achieved at a higher level.

Figure 13A:
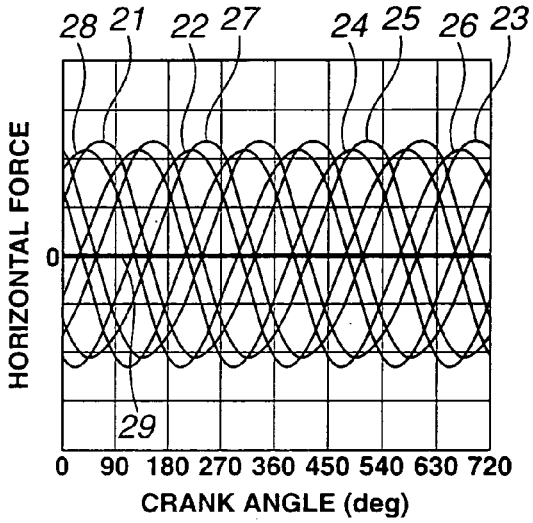
FIGS. 13A, 13B, 13C and 13D are graphs similar to FIGS. 11A, 11B, 11C and 11D, but showing inertia forces and moments of eight pistons in case of the engine of Reference-2.
Figure 13B:
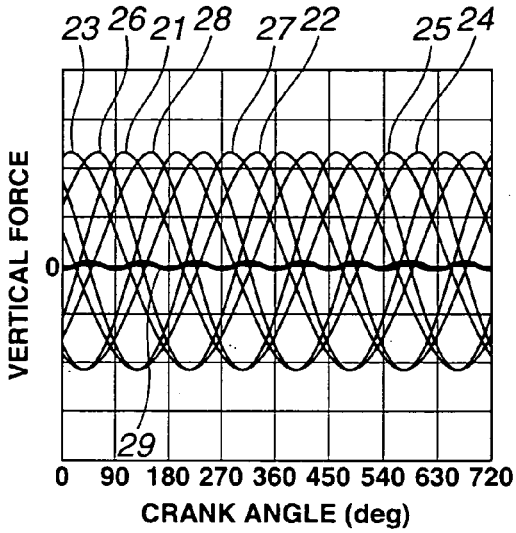
Figure 13C:
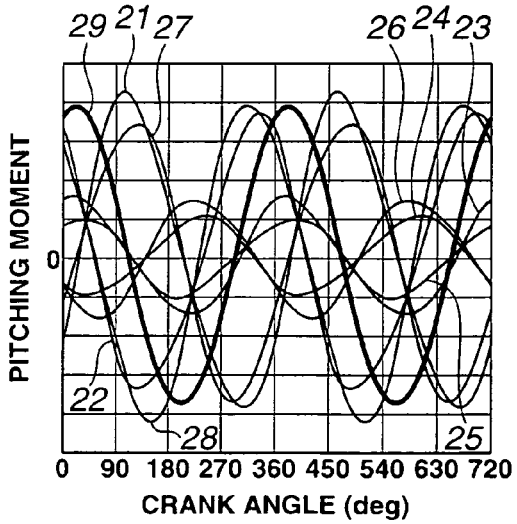
Figure 13D:
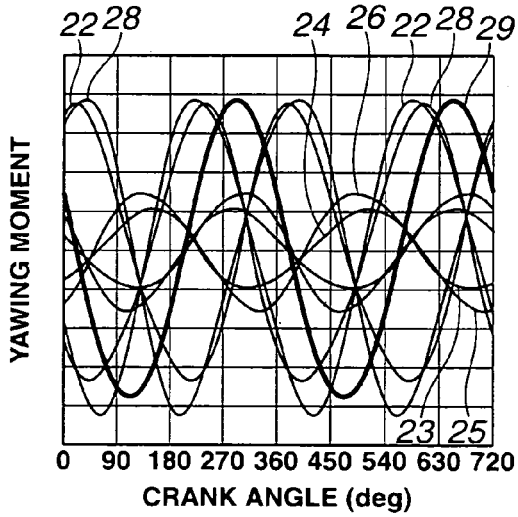

As is seen from the graphs of FIGS. 13C and 13D, in the engine "Reference-2" (viz., the engine to which the single link type piston-crank mechanism and the double plane type crankshaft 101 are practically applied), a quite high primary vibration moment is generated as compared with the engine 100 of the present invention. Although such primary vibration moment can reduced by employment of counterweights, increase in weight and size of the engine is inevitably induced.

In the following, modifications of the engine 100 of the present invention will be described.

In the foregoing description, the double link type piston-crank mechanism applied to the engine 100 is of a type that uses control shafts 5A and 5B for varying the compression ratio of the engine 100. However, if desired, the double link type piston-crank mechanism may be of a type that has no means for varying the compression ratio of the engine if the mechanism is constructed to reduce the secondary vibration component of the inertia force of pistons 8.

Furthermore, in the foregoing description, the crankshaft 1 applied to the engine 100 is of a single plane type wherein journal portions 9 and all of the crank pins 2 are arranged on a common imaginary plane. However, if desired, the crankshaft may be of a double plane type if the crankshaft is constructed to improve the fuel consumption characteristic and power output characteristic of the engine.

In the following, constructional features of the engine 100 of the present invention and advantages induced by such features will be described.

(1) The engine 100 of the invention is a V-type 8-cylinder four cycle internal combustion engine with a bank angle of 90 deg. and has a double link type piston-crank mechanism that comprises, for each piston, a lower link 3 pivotally connected to a crank pin 2 of a crankshaft 1, an upper link 7 having an upper end pivotally connected to a piston 8 through a piston pin 8*a* and a lower end pivotally connected to the lower link 3 and a control link 4A or 4B having one end pivotally connected to the lower link 3 and the other end swingably connected to a body of the engine.

In the V-type 8-cylinder four cycle engine 100 with the bank angle of 90 deg. according to the present invention, a high engine power can be outputted despite its compact size. Because of employment of the double-link type piston-crank mechanism, the reciprocating motion of each piston 8 can be made very smooth as has been mentioned hereinabove. That is, the secondary vibration component of the inertia force of each piston 8 is effectively reduced. Accordingly, in the V-type 8 cylinder engine 100 of the present invention, the high output effect and high vibration reduction effect are achieved at the same time at a higher level.

(2) In the engine 100 of the invention, two axially adjacent lower links 3 (for example, the lower links 3#1 and 3#2 in FIG. 1) that are connected through respective upper links 7 to adjacent pistons 8 (for example, the pistons #1 and #2) in respective banks are connected to a common crank pin 2 of crankshaft 1. The crankshaft 1 is of a single plane type.

Due to employment of the single plane type crankshaft 1, the firing interval is 180 deg. for each bank and thus intake and exhaust timings have the same internal. Thus, intake interference and/or exhaust interference of each bank can be avoided or at least minimized, and thus, pulsation effect can be easily used, which improves the output performance of the engine. However, such crankshaft 1 fails to exhibit a sufficient performance in reducing the vibration. However, due to employment of the double link type piston-crank mechanism, the disadvantage induced by the single plane type crankshaft 1 is made up. That is, even when single plane type crankshaft 1 is employed for achieving a higher output power of the engine 100, the undesired vibration of the engine 100 can be sufficiently reduced. If the common control shaft 5A or 5B is swingably connected to the cylinder block, the compression ratio the cylinders can be varied in accordance with the operation condition of the engine 100.

(3) In the engine 100 of the invention, the size and layout of the parts of the double link type piston-crank mechanism should be set to make the secondary vibration component of the inertia force of each piston 8 as small as possible. With this setting, the secondary vibration component of the inertial force that is an undesirable point of the single plane type crankshaft 1 is cancelled. Due to the same reason, the secondary vibration component of the inertial force for each cylinder is reduced, and thus, undesired deformation of the cylinder block that is caused by such component is suppressed, and deterioration of lubricating condition at the bearings is suppressed.

(4) Theoretically, the reciprocating movement of each piston 8 can be set to a simple harmonic motion. If so, vibration components other than the primary vibration component can be reduced to zero. In this case, the vibration of the engine can be effectively reduced throughout a large frequency range.

(5) If desired, a suitable swinging mechanism is connected to the engine 100 for causing the leading end of each control link 4A or 4B to swing in accordance with an operation condition of the engine 100. With such swinging mechanism, the compression ratio of each cylinder can be varied and thus the fuel consumption characteristic and power output characteristic of the engine 100 are improved.

(6) The swinging mechanism may be of a type that comprises control shaft 5A or 5B (see FIG. 1) that is rotatably connected to a cylinder block, an electric actuator (not shown) that rotates the control shaft 5A or 5B to a desired angular position in accordance with the engine operation condition, and eccentric portions 6 that are provided on control shaft 5A or 5B and pivotally connected to the leading ends of control links 4A or 4B respectively. By changing the angular position of control shafts 5A or 5B by the electric actuator, the compression ratio of the engine 100 is varied. Since control shaft 5A or 5B is connected to lower links 3, not to upper links 7, it is easy to determine a position where control shaft 5A or 5B is set, that is, the position that has a room for the shaft 5A or 5B.

The entire contents of Japanese Patent Application 2004-162679 filed Jun. 1, 2004 are incorporated herein by reference.

Although the invention has been described above with reference to the embodiment of the invention, the invention is not limited to such embodiment as described above. Various modifications and variations of such embodiment may be carried out by those skilled in the art, in light of the above description.

What is claimed is:

1. A V-type 8-cylinder four cycle internal combustion engine with a bank angle of 90 degrees, comprising:

a first group of four pistons respectively received in cylinders formed in a first bank;

a second group of four pistons respectively received in cylinders defined in a second bank;

a crankshaft including four throws each having a crank pin;

a first group of four upper links each having one end pivotally connected to one of the pistons of the first group;

a second group of four upper links each having one end pivotally connected to one of the pistons of the second group;

a first group of four lower links rotatably and respectively supported by the four crank pins of the throws of the crankshaft, each lower link of the first group having one end pivotally connected to the other end of the corresponding upper link of the first group;

a second group of four lower links rotatably and respectively supported by the four crank pins of the throws of the crankshaft, each lower link of the second group having one end pivotally connected to the other end of the corresponding upper link of the second group;

a first group of four control links each having one end pivotally connected to the other end of the corresponding lower link of the first group and the other end pivotally connected to a cylinder block; and a second group of four control links each having one end pivotally connected to the other end of the corresponding lower link of the second group and the other end pivotally connected to the cylinder block, wherein each piston is pivotally connected to the corresponding upper link through a piston pin.

2. A V-type 8-cylinder four cycle internal combustion engine with a bank angle of 90 deg., comprising:

a first group of four pistons respectively received in cylinders formed in a first bank;

a second group of four pistons respectively received in cylinders defined in a second bank;

a crankshaft including four throws each having a crank pin;

a first group of four upper links each having one end pivotally connected to one of the pistons of the first group;

a second group of four upper links each having one end pivotally connected to one of the pistons of the second group;

a first group of four lower links rotatably and respectively supported by the four crank pins of the throws of the crankshaft, each lower link of the first group having one end pivotally connected to the other end of the corresponding upper link of the first group;

a second group of four lower links rotatably and respectively supported by the four crank pins of the throws of the crankshaft, each lower link of the second group having one end pivotally connected to the other end of the corresponding upper link of the second group;

a first group of four control links each having one end pivotally connected to the other end of the corresponding lower link of the first group and the other end pivotally connected to a cylinder block; and a second group of four control links each having one end pivotally connected to the other end of the corresponding lower link of the second group and the other end pivotally connected to the cylinder block, wherein the firing intervals is 180 degrees in crank angle for each bank.

3. A V-type 8-cylinder four cycle internal combustion engine with a bank angle of 90 deg., comprising:

a first group of four pistons respectively received in cylinders formed in a first bank;

a second group of four pistons respectively received in cylinders defined in a second bank, the second bank intersecting the first bank at an angle of 90 deg.;

a single plane type crankshaft that has four throws placed on a common plane, each throw having a crank pin;

a first group of four upper links each having one end pivotally connected to one of the pistons of the first group through a piston pin;

a second group of four upper links each having one end pivotally connected to one of the pistons of the second group through a piston pin;

a first group of four lower links rotatably and respectively supported by the four crank pins of the throws of the crankshaft, each lower link of the first group having one end pivotally connected to the other end of the corresponding upper link of the first group;

a second group of four lower links rotatably and respectively supported by the four crank pins of the throws of the crankshaft, each lower link of the second group having one end pivotally connected to the other end of the corresponding upper link of the second group;

a first group of four control links each having one end pivotally connected to the other end of the corresponding lower link of the first group;

a second group of four control links each having one end pivotally connected to the other end of the corresponding lower link of the second group;

a first control shaft rotatably supported by a cylinder block, the first control shaft having four eccentric portions to which the other ends of the control links of the first group are pivotally connected; and a second control shaft rotatably supported by the cylinder block, the second control shaft having four eccentric portions to which the other ends of the control links of the second group are pivotally connected.

4. A V-type 8-cylinder four cycle internal combustion engine comprising:

a first group of four pistons respectively received in cylinders of a first bank;

a second group of four pistons respectively received in cylinders of a second bank, the second bank intersecting the first bank at an angle of 90 deg.;

a crankshaft including four throws each having a crank pin;

a first upper link having one end pivotally connected to one of the four pistons of the first group;

a second upper link having one end pivotally connected to one of the four pistons of the second group;

a first lower link rotatably supported by the crank pin of the crankshaft and having one end pivotally connected to the other end of the first upper link;

a second lower link rotatably supported by the crank pin of the crankshaft and having one end pivotally connected to the other end of the second upper link;

a first control link having one end pivotally connected to the other end of the first lower link and the other end pivotally connected to a cylinder block; and a second control link having one end pivotally connected to the other end of the second lower link and the other end pivotally connected to the cylinder block, wherein the first and second lower links are rotatably supported by the same crank pin of the crankshaft, and wherein the crankshaft is of a single plane type in which the four throws of the crankshaft are in the same plane.

5. A V-type 8-cylinder four cycle internal combustion engine as claimed in claim 4, further comprising:

a first control shaft rotatably supported by the cylinder block and having an eccentric portion to which the other end of the first control link is pivotally connected;

a second control shaft rotatably supported by the cylinder block and having an eccentric portion to which the other end of the second control link is pivotally connected; and an actuator that rotates each of the first and second control shafts to a desired angular position in accordance with an operation condition of the engine.

6. A V-type 8-cylinder four cycle internal combustion engine with a bank angle of 90 deg., comprising:

a first group of four pistons respectively received in cylinders formed in a first bank;

a second group of four pistons respectively received in cylinders defined in a second bank;

a crankshaft including four throws each having a crank pin;

a first group of four upper links each having one end pivotally connected to one of the pistons of the first group;

a second group of four upper links each having one end pivotally connected to one of the pistons of the second group;

a first group of four lower links rotatably and respectively supported by the four crank pins of the throws of the crankshaft, each lower link of the first group having one end pivotally connected to the other end of the corresponding upper link of the first group;

a second group of four lower links rotatably and respectively supported by the four crank pins of the throws of the crankshaft, each lower link of the second group having one end pivotally connected to the other end of the corresponding upper link of the second group;

a first group of four control links each having one end pivotally connected to the other end of the corresponding lower link of the first group and the other end pivotally connected to a cylinder block; and a second group of four control links each having one end pivotally connected to the other end of the corresponding lower link of the second group and the other end pivotally connected to the cylinder block, wherein the crankshaft is of a single plane type in which the four throws of the crankshaft are in the same plane.

7. A V-type 8-cylinder four cycle internal combustion engine as claimed in claim 6, in which one of the lower links of the first group and one of the lower links of the second group are incorporated with one of the four crank pins of the crankshaft.

8. A V-type 8-cylinder four cycle internal combustion engine with a bank angle of 90 deg., comprising:

a first group of four pistons respectively received in cylinders formed in a first bank;

a second group of four pistons respectively received in cylinders defined in a second bank;

a crankshaft including four throws each having a crank pin;

a first group of four upper links each having one end pivotally connected to one of the pistons of the first group;

a second group of four upper links each having one end pivotally connected to one of the pistons of the second group;

a first group of four lower links rotatably and respectively supported by the four crank pins of the throws of the crankshaft, each lower link of the first group having one end pivotally connected to the other end of the corresponding upper link of the first group;

a second group of four lower links rotatably and respectively supported by the four crank pins of the throws of the crankshaft, each lower link of the second group having one end pivotally connected to the other end of the corresponding upper link of the second group;

a first group of four control links each having one end pivotally connected to the other end of the corresponding lower link of the first group and the other end pivotally connected to a cylinder block;

a second group of four control links each having one end pivotally connected to the other end of the corresponding lower link of the second group and the other end pivotally connected to the cylinder block, a first control shaft supported by the cylinder block, the first control shaft having four portions to which the other ends of the four control links of the first group are pivotally connected; and a second control shaft supported by the cylinder block, the second control shaft having four portions to which the other ends of the four control links of the second group are pivotally connected.

9. A V-type 8-cylider four cycle internal combustion engine as claimed in claim 8, in which each of the first and second control shafts is rotatably supported by the cylinder block, and in which the four portions of each of the first and second control shafts are portions which are eccentric relative to an axis of each of the first and second control shafts.

10. A V-type 8-cylinder four cycle internal combustion engine as claimed in claim 9, further comprising an actuator that rotates each of the first and second control shafts to a desired angular position in accordance with an operation condition of the engine.

11. A V-type 8-cylinder four cycle internal combustion engine as claimed in claim 9, in which the first and second control shafts are arranged at the same side of the engine.

* * * * *